US010615020B2

(12) United States Patent
Patel et al.

(10) Patent No.: US 10,615,020 B2
(45) Date of Patent: Apr. 7, 2020

(54) SYSTEMS AND METHODS USING A GAS MIXTURE TO SELECT IONS

(71) Applicant: PERKINELMER HEALTH SCIENCES CANADA, INC., Woodbridge (CA)

(72) Inventors: Pritesh Patel, Pickering (CA); Chady Stephan, Brampton (CA); Fadi Abou-Shakra, North York (CA)

(73) Assignee: PerkinElmer Health Sciences Canada, Inc., Woodbridge (ON) (CA)

( * ) Notice: Subject to any disclaimer, the term of this patent is extended or adjusted under 35 U.S.C. 154(b) by 0 days.

(21) Appl. No.: 16/119,141

(22) Filed: Aug. 31, 2018

(65) Prior Publication Data

US 2019/0080893 A1 Mar. 14, 2019

Related U.S. Application Data

(60) Provisional application No. 62/553,456, filed on Sep. 1, 2017, provisional application No. 62/569,513, filed on Oct. 7, 2017.

(51) Int. Cl.

| | |
|---|---|
| ***H01J 49/24*** | (2006.01) |
| ***H01J 49/10*** | (2006.01) |
| ***H01J 49/02*** | (2006.01) |
| ***H01J 49/06*** | (2006.01) |
| ***H01J 49/00*** | (2006.01) |

(52) U.S. Cl.

CPC ..... *H01J 49/025* (2013.01); *H01J 49/005* (2013.01); *H01J 49/0072* (2013.01); *H01J 49/0077* (2013.01); *H01J 49/063* (2013.01); *H01J 49/067* (2013.01); *H01J 49/105* (2013.01)

(58) Field of Classification Search

CPC ..... H01J 49/105; H01J 49/24; H01J 49/005; H01J 49/0077; H01J 49/0045; H01J 49/061; H01J 49/063; H01J 49/10; H01J 49/421; H01J 49/04; H01J 49/06; H01J 49/067; H01J 49/147; H01J 49/26; H01J 49/4265

USPC ..... 250/288, 282, 281, 292, 283, 287, 306, 250/492.3, 582

See application file for complete search history.

(56) References Cited

U.S. PATENT DOCUMENTS

| | | | | |
|---|---|---|---|---|
| 5,942,752 A * | 8/1999 | Wang | H01J 49/063 250/288 |
| 5,969,352 A * | 10/1999 | French | H01J 49/105 250/288 |
| 6,627,912 B2 * | 9/2003 | Bandura | H01J 49/0045 250/292 |
| 7,145,133 B2 | 12/2006 | Thomson | |
| RE39,627 E * | 5/2007 | Tanner | H01J 49/067 250/281 |
| 7,928,363 B2 | 4/2011 | Bateman | |
| 8,426,804 B2 | 4/2013 | Badiei | |
| 9,343,280 B2 * | 5/2016 | Cousins | H01J 49/24 |

(Continued)

OTHER PUBLICATIONS

ISR/WO for PCT/IB2018/056682 dated Jan. 4, 2019.

*Primary Examiner* — David A Vanore
(74) *Attorney, Agent, or Firm* — Rhodes IP PLC; Christopher R. Rhodes

(57) ABSTRACT

Certain configurations described herein are directed to mass spectrometer systems that can use a gas mixture to select and/or detect ions. In some instances, the gas mixture can be used in both a collision mode and in a reaction mode to provide improved detection limits using the same gas mixture.

20 Claims, 7 Drawing Sheets

(56) References Cited

U.S. PATENT DOCUMENTS

| | | | | |
|---|---|---|---|---|
| 9,449,803 | B2 * | 9/2016 | Jolliffe | H01J 49/0468 |
| 2009/0039251 | A1 * | 2/2009 | Yamada | H01J 49/105<br>250/288 |
| 2011/0210241 | A1 * | 9/2011 | Badiei | G05D 7/0635<br>250/282 |
| 2011/0253888 | A1 * | 10/2011 | Badiei | H01J 49/105<br>250/282 |
| 2012/0091331 | A1 * | 4/2012 | Badiei | H01J 49/005<br>250/282 |
| 2013/0284917 | A1 * | 10/2013 | Badiei | H01J 49/005<br>250/288 |
| 2015/0235827 | A1 * | 8/2015 | Bazargan | H01J 49/0009<br>702/116 |
| 2015/0318159 | A1 * | 11/2015 | Badiei | H01J 49/105<br>250/282 |
| 2016/0203964 | A1 * | 7/2016 | Damoc | H01J 49/0031<br>250/283 |
| 2018/0240657 | A1 | 8/2018 | Schwieters | |

* cited by examiner

SYSTEMS AND METHODS USING A GAS MIXTURE TO SELECT IONS

PRIORITY APPLICATIONS

This application is related to, and claims priority to and the benefit of, each of U.S. Provisional Application No. 62/553,456 filed on Sep. 1, 2017 and U.S. Provisional Application No. 62/569,513 filed on Oct. 7, 2017, the entire disclosure of each of which is hereby incorporated herein by reference for all purposes.

TECHNOLOGICAL FIELD

Certain embodiments described herein are related to systems and methods which use a gas mixture to select ions. More particularly, certain configurations described herein are directed to use of a binary gas mixture with a multimode cell to select analyte ions from an ion beam.

BACKGROUND

Mass spectrometry (MS) is an analytical technique that can determine the elemental composition of unknown sample substances. For example, MS can be useful for identifying unknown compounds, determining the isotopic composition of elements in a molecule, and determining the structure of a particular compound by observing its fragmentation, as well as for quantifying the amount of a particular compound in the sample.

SUMMARY

Certain aspects, embodiments, examples, configurations and illustrations of systems and methods that can use a common gas mixture to select analyte ions and/or suppress interfering ions are described below In one aspect, a system configured to permit switching of a cell between at least two modes comprising a collision mode and a reaction mode to select ions received by the cell is described. In certain examples, the system comprises a cell configured to receive a gas mixture comprising a binary gas mixture (or a gas mixture comprising at least two gases) in the collision mode to pressurize the cell and configured to receive the same gas mixture comprising the binary gas mixture (or a gas mixture comprising at least two gases) in the reaction mode to pressurize the cell. In some examples, the system comprises a processor electrically coupled to the cell, the processor configured to provide a voltage to the pressurized cell comprising the gas mixture in the collision mode to facilitate the transmission of select ions with an energy greater than an energy barrier induced by the provided first voltage. In other examples, the processor is further configured to provide a second voltage to the pressurized cell comprising the gas mixture in the reaction mode to guide select ions into a mass filter fluidically coupled to the cell.

In some embodiments, the processor is further configured to permit switching of the cell to a vented mode. In other embodiments, the system further comprises a single gas inlet fluidically coupled to the cell to provide the gas mixture comprising the binary gas mixture. In certain examples, the cell comprises a multipole rod set comprising 2, 4, 6, 8, or 10 rods.

In other examples, the cell further comprises an exit member positioned proximate to an exit aperture of the cell and electrically coupled to a voltage source, the exit member configured to direct analyte ions in the pressurized cell toward the exit aperture of the cell. In certain examples, the exit member can be set at a voltage between −60 Volts and +20 Volts in the collision mode of the pressurized cell. In some examples, the exit member can be set at a voltage between −60 Volts and +20 Volts in the reaction mode of the pressurized cell.

In some configurations, the cell further comprises an entrance member positioned proximate to an entrance aperture of the cell and electrically coupled to a voltage source, the entrance member configured to direct analyte ions into the pressurized cell toward the entrance aperture of the cell. In certain instances, the entrance member can be set at a voltage between −60 Volts and +20 Volts in the collision mode of the pressurized cell. In other examples, the entrance member can be set at a voltage substantially similar to a voltage provided to the exit member when the pressurized cell is in the reaction mode.

In other examples, the cell is configured to switch from the collision mode to the reaction mode while operating at the same gas flow. In other instances, the cell is configured to switch from the collision mode to the reaction mode, and a different gas flow level can be used in the different modes. In some examples, the voltages on the entrance member and exit member can be altered and optionally the energy barrier between the cell and the mass analyzer can also be changed.

In some examples, the cell is configured to switch from the reaction mode to the collision mode while maintaining the same gas flow or changing to a different flow level by switching the voltages on the entrance member and the exit member and optionally changing the energy barrier between the cell and the mass analyzer.

In other configurations, the system may comprise axial electrodes electrically coupled to a voltage source and configured to provide an axial field to direct ions toward an exit aperture of the pressurized cell. For example, the axial field comprises a field gradient between −500 V/cm and 500 V/cm.

In certain examples, the processor is further configured to provide an offset voltage to the pressurized cell. In other examples, the system may comprise a mass analyzer fluidically coupled to the cell comprising the offset voltage. In some examples, an offset voltage of the fluidically coupled mass analyzer is more positive than the offset voltage of the cell when the cell is in the collision mode. In certain examples, an offset voltage of the fluidically coupled mass analyzer is more negative than the offset voltage of the cell when the cell is in the reaction mode.

In some instances, the system comprises an ionization source fluidically coupled to the cell.

In other instances, the cell is configured to use a binary mixture of helium gas and hydrogen gas in the collision mode and in the reaction mode.

In another aspect, a mass spectrometer system comprises an ion source, a cell fluidically coupled to the ion source, a mass analyzer fluidically coupled to the cell and a processor electrically coupled to the cell.

In certain instances, the cell is configured to operate in at least three different modes comprising a collision mode, a reaction mode and a standard mode. For example, the three different modes can each be configured to select analyte ions from a plurality of ions received into the cell from the ion source. In some instances, the cell is configured to couple to the ion source at an entrance aperture to permit receipt of the plurality of ions from the ion source. In certain configurations, the cell comprises a gas inlet configured to receive a gas mixture comprising a binary gas mixture (or a gas mixture comprising at least two gases) in the collision mode to pressurize the cell in the collision mode. In other instances, the cell is configured to receive the gas mixture comprising the binary gas mixture (or a gas mixture comprising at least two gases) in the reaction mode to pressurize the cell in the reaction mode. In some examples, the cell further comprises an exit aperture configured to provide the analyte ions from the cell.

In some examples, the processor electrically coupled to the cell is configured to provide the gas mixture to the cell in each of the collision mode and the reaction mode and to maintain the cell under vacuum in the standard mode.

In some embodiments, the cell comprises a multipole rod set comprising 2, 4, 6, 8 or 10 rods.

In certain examples, the processor is configured to provide a first voltage to the pressurized cell comprising the gas mixture in the collision mode to select ions comprising an energy greater than a selected barrier energy. In other examples, the processor is configured to provide a second voltage to the pressurized cell comprising the gas mixture in the reaction mode to select ions using mass filtering.

In some examples, the system comprises axial electrodes configured to provide an axial field to direct the analyte ions from the entrance aperture toward an exit aperture of the pressurized cell. In certain instances, the axial field strength comprises an axial field gradient between −500 V/cm and +500 V/cm.

In some configurations, the system comprises an exit member, e.g., an exit lens, positioned proximate to an exit aperture of the pressurized cell. For example, the exit member comprises an exit potential to attract analyte ions toward the exit aperture of the pressurized cell. In some instances, the exit member comprises a voltage between −26 Volts and +26 Volts in the collision mode of the pressurized cell. In other instances, the exit member comprises a voltage between −26 Volts and +26 Volts in the reaction mode of the pressurized cell.

In some configurations, the system comprises an entrance member, e.g., an entrance lens, positioned proximate to an entrance aperture of the pressurized cell, the entrance member comprising an entrance potential more positive than the exit potential in the collision mode. In some examples, the entrance potential is between −40 Volts and +10 Volts. In other examples, the entrance member comprises an entrance potential substantially similar to the exit potential in the reaction mode. For examples, the exit potential can be between −40 Volts and +10 Volts in the collision mode and/or between −40 Volts and +10 Volts in the reaction mode.

In some examples, the system may comprise an ion deflector positioned between the ion source and the cell. In certain embodiments, the system may comprise a detector fluidically coupled to the cell. In other embodiments, the detector comprises an electron multiplier. In some examples, the ion source is configured as an inductively coupled plasma. In certain instances, the system may comprise an interface positioned between the inductively coupled plasma and the mass analyzer.

In some configurations, the system may comprise a fluid line configured to introduce the gas mixture comprising the binary gas mixture into the interface of the system or into another component of the system upstream of the cell.

In another aspect, a method of selecting ions using a mass spectrometer comprises providing an ion stream comprising a plurality of ions from an ion source into a pressurized cell configured to operate in a reaction mode and in a collision mode using a gas mixture comprising a binary gas mixture (or a gas mixture comprising at least two gases). In some instances, the gas mixture is introduced into the cell in each of the reaction mode and the collision mode of the cell to pressurize the cell. The method also comprises selecting ions, from the plurality of ions in the pressurized cell comprising the gas mixture, that comprise an energy greater than a selected barrier energy when the cell is in the collision mode, and selecting ions, from the plurality of ions in the ion stream provided to the pressurized cell comprising the gas mixture, using mass filtering when the cell is in the reaction mode.

In some examples, the method comprises configuring the cell as a multipole rod cell, e.g., one comprising 2, 4, 6, 8 or 10 rods.

In some instances, the method comprises providing an exit barrier at an exit aperture of the pressurized cell by providing a potential to an exit member positioned proximate to the exit aperture.

In other instances, the method comprises providing a potential to an entrance member positioned proximate to an entrance aperture of the cell, the potential provided to the entrance member configured to focus the plurality of ions received by the cell from the ion source upstream of a rod set of the cell.

In some examples, the method comprises configuring the gas mixture to comprise hydrogen and helium.

In certain examples, the method comprises configuring the gas mixture to comprise at least one additional inert gas.

In other examples, the method comprises combining a first gas and a second gas upstream of the cell to provide the gas mixture.

In certain examples, the method comprises altering a flow rate of the gas mixture provided to the cell when the cell is switched from the collision mode to the reaction mode (or vice versa).

In some embodiments, the method comprises configuring the cell with a single gas inlet configured to receive the gas mixture.

In other examples, the method comprises configuring a first gas to comprise up to about 15% by volume of the gas mixture.

In another aspect, a method of selecting ions using a cell comprising a multipole rod set, e.g., 2, 4, 6, 8, or 10 rods, configured to operate in each of a collision mode and a reaction mode to select ions from an ion stream comprising a plurality of ions is provided. In some examples, the method comprises providing the binary gas mixture to the cell in the collision mode to select ions comprising an energy greater than a selected barrier energy and providing the binary gas mixture to the cell in the reaction mode to select ions using mass filtering.

Additional aspects, embodiments, examples, configurations and illustrations of systems and methods that can use a common gas mixture to select analyte ions and/or suppress interfering ions will be recognized by the person of ordinary skill in the art, given the benefit of this disclosure.

BRIEF DESCRIPTION OF THE SEVERAL VIEWS OF THE DRAWINGS

Certain configurations are described below with reference to the accompanying drawings in which.

It will be recognized by the person of ordinary skill in the art, given the benefit of this disclosure, that additional components may be present in the figures. Further, certain components can be omitted and still provide a system suitable for analysis of analyte ions of interest.

DETAILED DESCRIPTION

Certain configurations described herein use a gas mixture in combination with a multimode cell to select ions from an incoming ion beam and/or to suppress or remove interfering ions present in the incoming ion beam. While the exact system that includes the multimode cell can vary, the multimode cell is typically part of a larger system including an ionization source and optionally other components or stages.

In certain examples, an ionization source typically provides numerous different types of ions. Some of these ions can be analyte of interest ions and some of these ions can be interfering ions. For example, where an ionization source comprises an argon based plasma, the ion stream may comprise analyte ions and numerous different types of argon species including Ar, $Ar^+$, $ArO^+$, $Ar_2^+$, $ArCl^+$, $ArH^+$ and $MAr^+$ where M represents a metal species. Additional non-argon based interferences may also include $ClO^+$, $MO^+$ and other interferences. Interfering ions can also be produced at other parts of the system, e.g., at an interface or at other areas of the system. In many systems, it is desirable to eliminate or remove (at least to some degree) the interfering or unwanted ions.

Figure 1:
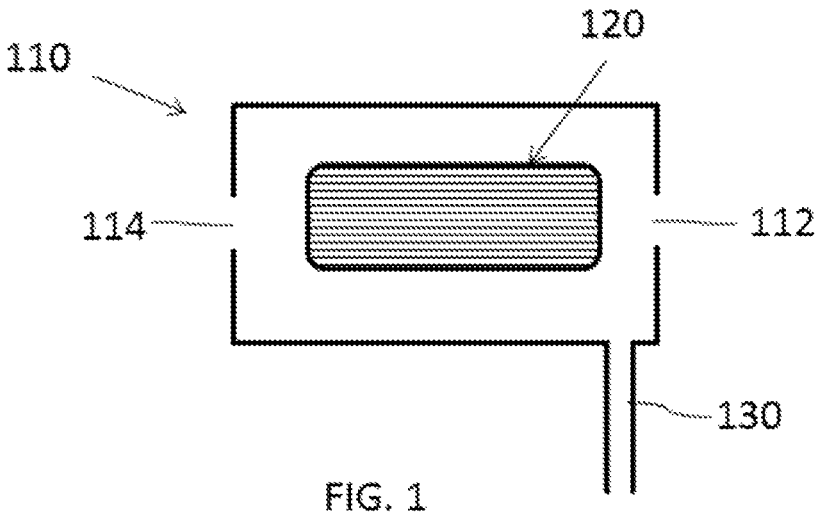
FIG. 1 is an illustration of a multimode cell comprising a gas inlet, in accordance with certain configurations.

In certain embodiments and referring to FIG. 1, an illustration of a multimode cell 110 comprising an inlet 112, an outlet 114, a rod set 120 and a gas inlet 130 is shown. The gas inlet 130 is typically fluidically coupled to one or more gas sources or a gas source comprising a gas mixture. As described in more detail below, the gas inlet 130 may be the only gas inlet present for the cell 110. The gas inlet 130 can be used to provide the gas mixture to the cell in at least two modes of the cell, e.g., substantially the same or the same gas mixture can be provided to the cell in a reaction mode (DRC mode) and in a collision mode (KED mode). As described in more detail below, the multimode cell 110 may comprise a reaction mode and a collision mode in the same cell. Without wishing to be bound by any particular theory, in the reaction mode, the cell 110 can be filled with the gas mixture that is reactive with one or more of the unwanted interfering ions, while remaining more or less inert toward the analyte ions. As the ion stream collides with the reactive gas mixture in the cell 110, the interfering ions can form product ions that no longer have substantially the same or similar mass-to-charge (m/z) ratio as the analyte ions. If the m/z ratio of the product ion substantially differs from that of the analyte ions, then conventional mass filtering can then be used to eliminate the product interfering ions without significant disruption of the flow of analyte ions. For example, the ion stream can be subjected to a band pass mass filter to provide or transmit only the analyte ions to the mass analyzer stage in significant proportions. As discussed in more detail below, radial confinement of ions can be provided within the cell 110 by forming a radial RF field within an elongated rod set 120. Confinement fields of this nature can, in general, be of different orders, but are commonly either a quadrupolar field, or else some higher order field, such as a hexapolar or octopolar field. For example, application of small DC voltages to a quadrupole rod set, in conjunction with the applied quadrupolar RF, can destabilize ions of m/z ratios falling outside of a narrow, tunable range, thereby creating a form of mass filter for ions.

In certain configurations, the cell 110 can also be used in a collision more or kinetic energy discrimination (KED) mode. In the collision mode, the cell 110 can use the same gas mixture as in the reaction mode. For example, the gas mixture can be introduced into the cell 110 through the inlet 130 and the gas mixture collides with the ion stream inside the cell 110. Both the analyte ions and interfering ions can collide with the gas molecules of the gas mixture causing an average loss of kinetic energy in the ions. The amount of kinetic energy lost due to the collisions can in general be related to the collisional cross-section of the ions, which can be related to the elemental composition of the ion. Polyatomic ions (also known as molecular ions) composed of two or more bonded atoms tend to have a larger collisional cross-section than do monatomic ions, which are composed only of a single charged atom. While not wishing to be bound by any particular theory, the gas molecules of the gas mixture have a greater probability of colliding with the polyatomic atoms to cause on average a greater loss of kinetic energy than will be seen in monatomic atoms of the same m/z ratio. A suitable energy barrier established at the downstream end of the cell 110 can then trap a significant portion of the polyatomic interfering ions and prevent transmission to the downstream mass analyzer. The collision mode can be more versatile and simpler to operate than the reaction mode but may have lower ion sensitivity than the reaction mode because some of the reduced energy analyte ions can become trapped, along with the interfering ions, and prevented from reaching a downstream component of the system, e.g., a mass analyzer stage. The same low levels of ions (e.g. parts and subparts per trillion) can therefore sometimes not be detected using the collision mode. For example, depending on the analyte ions of interest, the detection limits can be 10 to 1100 times worse using the collision mode relative to the detection limit using the reaction mode. In addition, collisions with the inert gas mixture cause a radial scattering of ions within the rod set. In some instances, quadrupolar fields or higher order confinement fields, including hexapolar and octopolar fields, can be used to provide deep radial potential wells and radial confinement. In the KED mode, the downstream energy barrier discriminates against the interfering ions in terms of their average kinetic energies relative to that of the analyte ions. Selection of the exact number of poles used can be based on, at least in part, easing requirements on the quality of ion stream, such as width of the beam and energy distributions of the respective ion populations in the beam, which in turn can ease requirements on other ion optical elements in the mass spectrometer and provide more versatility overall.

Certain configurations described herein permit the use of the same cell and the same gas mixture in both a collision mode and a reaction mode. The cell and gas mixture can be used in a mass spectrometer to select and detect analyte ions in a sample and/or remove or suppress interfering ions. The cell/system can be configurable for both a reaction mode and a collision mode and optionally other modes to suppress unwanted interfering ions. By controlling the ion source and other ion optical elements located upstream of the cell, as well as by controlling downstream components such as the mass analyzer to establish a suitable energy barrier, a multipole cell can be rendered operable for multiple different modes using the same or substantially similar gas mixture. Thus, a single multimode cell in the mass spectrometer system can operate in both the reaction and collision modes using a common gas mixture introduced into the cell during the different modes. A processor or controller can be used to control gas flows and voltage sources linked to the cell and a downstream mass analyzer to enable selectable, alternate operation of the mass spectrometer in the two or more modes.

Figure 2:
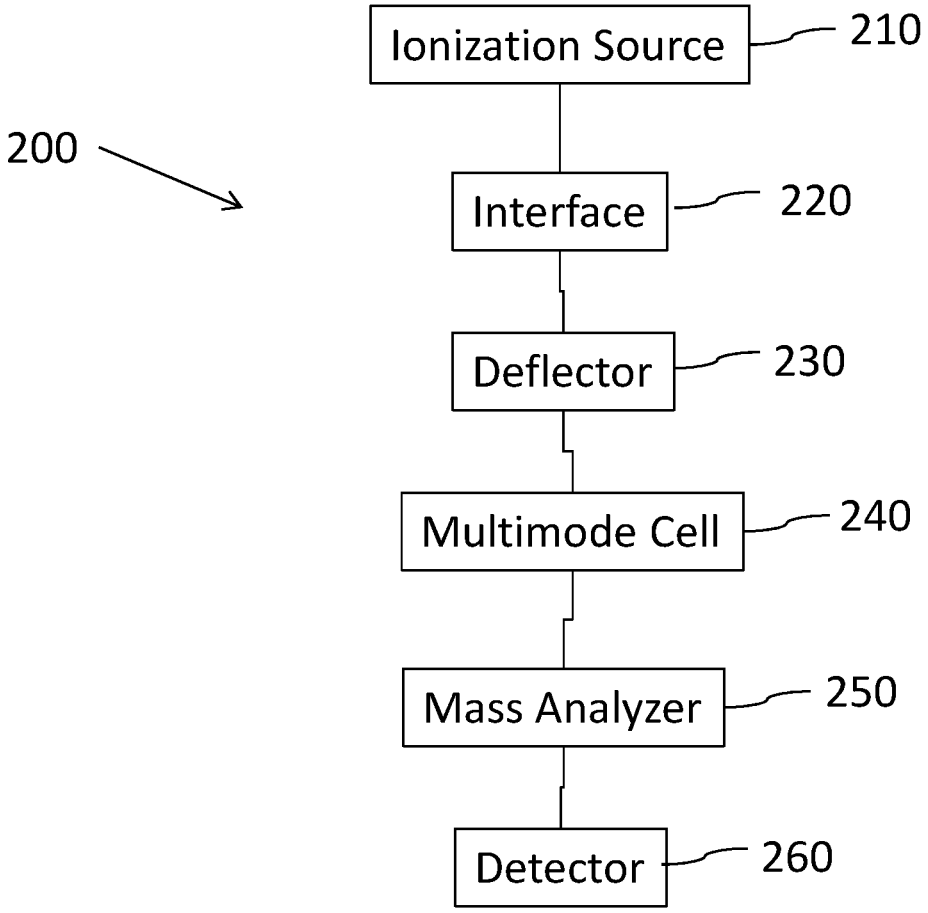
FIG. 2 is an illustration of a system comprising a multimode cell configured for use with a gas mixture, in accordance with certain examples.

In certain embodiments and referring to FIG. 2, a block diagram of certain components of a mass spectrometer system 200 is shown. The system 200 comprises an ionization source 210, an interface 220, a deflector 230, a cell 240, a mass analyzer 250 and a detector 260. While the exact ionization source 210 can vary and numerous types are mentioned below, the ionization source 210 typically generates spectral interferences, including various known inorganic spectral interferences, during ionization of analytes of interest. The ionization source 210, for example, can vaporize the analyte sample in a plasma torch to generate ions. Upon exiting the ionization source 210, ions can be extracted using the interface 220, e.g., one that may comprise a sampler plate and/or skimmer (see below). The ion extraction provided by the interface 220 can result in a narrow and highly focused ion stream that can be provided to one or more downstream components of the system 200. The interface 220 is typically present in a vacuum chamber evacuated by one or more pumps to an atmospheric pressure of about 3 Torr. If desired, the interface 220 may comprise multiple different stages, regions or chambers to enhance ion extraction further. For example, upon passing through the first skimmer of the interface 220, the ions can enter into a second vacuum region that comprises a second skimmer. A second mechanical pump (or a common mechanical pump fluidically coupled to a first vacuum region and the second vacuum region) can evacuate the second vacuum region to a lower atmospheric pressure than the first vacuum region. For example, the second vacuum region can be maintained at or about 1 to 110 milliTorr.

In certain configurations, as the ions exit the interface 220 they can be provided to the deflector 230. The deflector 230 is typically operative to select ions entering into the deflector 230 and provide them to a downstream component. For example, the ion deflector 230 can be configured as a quadrupole ion deflector, comprising a quadrupole rod set whose longitudinal axis extends in a direction that is approximately normal to entrance and exit trajectories of the ion stream. The quadrupole rods in the deflector 230 can be provided with suitable voltages from a power supply to provide a deflection field in the ion deflector quadrupole. Because of the configuration of the quadrupole rods and the applied voltages, the resulting deflection field can be effective at deflecting charged particles in the entering ion stream through an approximately 90 degree angle (or other selected angles). The exit trajectory of the ion stream can thus be roughly orthogonal to the entrance trajectory (as well as to the longitudinal axis of the quadrupole). If desired, however, the deflector or guide can be configured differently as described for example in U.S. Patent Publication Nos. 20170011900 and 20140117248. The ion deflector 230 can selectively deflect the various ion populations in the ion stream (both analyte and interfering ions) through to the exit, while other neutrally charged, non-spectral interferences are discriminated against. For example, the deflector 230 can selectively remove light photons, neutral particles (such as neutrons or other neutral atoms or molecules), as well as other gas molecules from the ion stream, which have little or no appreciable interaction with the deflection field formed in the multipole on account of their neutral change. The deflector 230 can be included in the mass spectrometer system 200 as one possible means of eliminating non-spectral interferers from the ion stream, though other means can also be used.

In certain configurations, the ion stream once exiting the deflector 230 along the exit trajectory can be transmitted to an entrance end of a multimode cell 240, which can be configured as a multimode cell comprising a reaction mode or a collision mode. As described in more detail below, an entrance member or lens can be present in the cell 240. The entry member or lens can provide an ion inlet for receiving the ion stream into the pressurized cell 240. If the deflector 230 is omitted from the mass spectrometer system 200, the ion stream may be transmitted directly from either the interface 220 to the cell 240 through the entrance member or lens. At an exit end of the pressurized cell 240 may be a suitable exit member, such as exit lens. The exit lens may provide an aperture through which ions traversing the pressurized cell 240 may be ejected to downstream analytical components of the mass spectrometer system 200 such as a mass analyzer 250 and a detector 260.

In certain examples, the cell 240 can be configured as a multipole pressurized cell, e.g., one including 2, 4, 6, 8 or 10 rods. For example, the cell 240 can be configured as a quadrupole pressurized cell enclosing a quadrupole rod set within its interior space. As is conventional, the quadrupole rod set can comprise four cylindrical rods arranged evenly about a common longitudinal axis that is collinear with the path of the incoming ion stream. The quadrupole rod set can be electrically coupled to a voltage source (not shown) to receive an RF voltage therefrom suitable for creating a quadrupolar field within the quadrupole rod set. For example, the field formed in the quadrupolar rod set can provide radial confinement for ions being transmitted along its length from the entrance end toward the exit end of the cell 240. As illustrated better in FIGS. 3A-3B, diagonally opposite rods in the quadrupole rod sets 340*a*, 340*b* can be coupled together to receive out-of-phase RF voltages, respectively, from the voltage source 342. A DC bias voltage may also, in some instances, be provided to the quadrupole rod sets 340*a*, 340*b*. Voltage source 342 can also supply a cell offset (DC bias) voltage to the cell 240. In some examples, the quadrupole rod sets 340*a*, 340*b* can be aligned collinearly with the entry lens and exit lens along its longitudinal axis, thereby providing a complete transverse path through the pressurized cell 240 for ions in the ion stream. In some examples, the entry lens may also be sized appropriately (e.g. 4.2 mm) to direct the ion stream entirely, or at least substantially, within an entrance ellipse and to provide the ion stream having a selected maximum spatial width, for example but without limitation, in the range of 2 mm to 3 mm. The entry lens can be sized so that most or all, but at a minimum a substantial part, of the ion stream is directed into the acceptance ellipse of the quadrupole rod set. The components of the interface 220, e.g., skimmers, may also be sized to affect the spatial width of the ion stream. In this way, the ion stream may be focused (to at least some degree) upstream of the cell 240 to reduce loss of ions and to provide efficient transmission through the cell 240.

Figure 4:
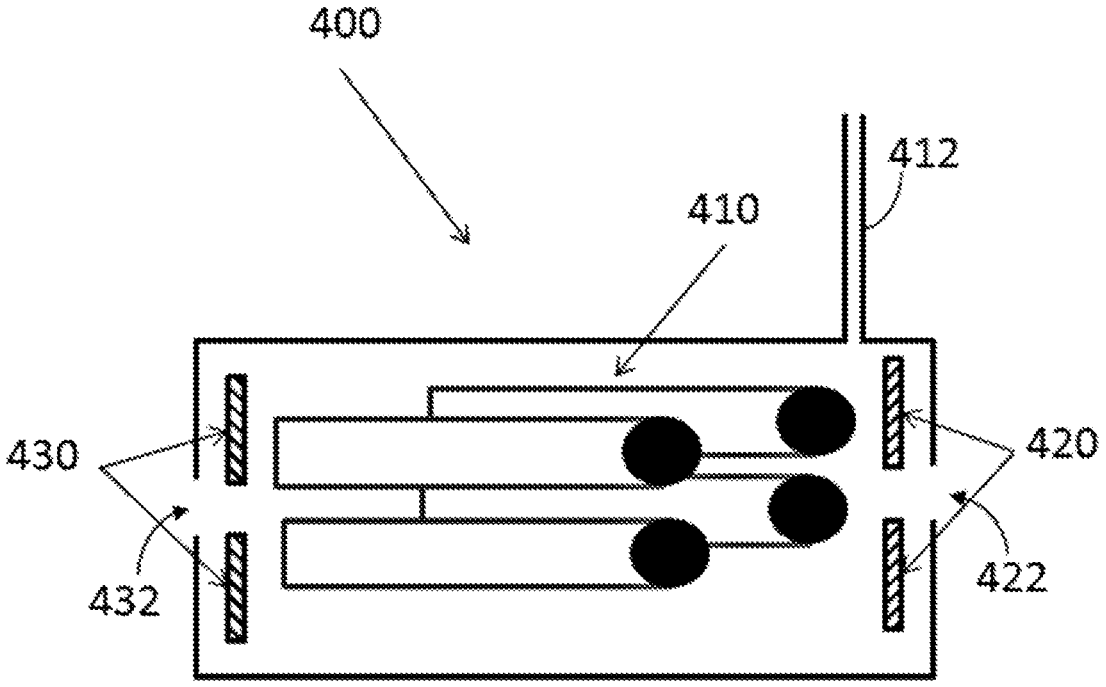
FIG. 4 is an illustration of a cell comprising an entrance member, an exit member and a quadrupole rod set, in accordance with certain examples.

In certain configurations, as shown in more detail in FIG. 4, a multimode cell 400 may comprise a gas inlet 430 fluidically coupled to the cell 400. An entrance member 420 can be present at an entrance 422 of the cell 400, and an exit member 430 can be present at an exit 432 of the cell 400. A gas inlet 412 is fluidically coupled to one or more gas sources to introduce a gas mixture into the cell 400 to pressurize the cell. In some examples, pre-mixed gases may be present in a gas source and introduced into the cell, whereas in other instances two or more gases can be mixed upstream of the cell 400 prior to introduction of the gas mixture into the cell 400. The source of gas can be operable to inject a quantity of a selected gas mixture into the pressurized cell 400 to collide with ions in the ion stream. The gas mixture typically comprises two or more different gases, e.g., two gases, three gases, four gases, etc. Illustrative gases in the gas mixture include, but are not limited to, hydrogen, helium, neon, argon, nitrogen, etc. In some examples, one or more of the gases may generally be inert toward both analyte ions and interfering ions in the ion stream. For example, assuming a first group of ions in the ion stream of a first polyatomic interfering ions, and a second group of ions in the ion stream of a second monatomic analyte ions, the inert gas of the gas mixture can collide with a substantially larger proportion of the first group of ions than with the second group of ions, to reduce the energies of the individual ions in the first group to a greater extent on average than the individual ions in the second group. Accordingly, the inert gas of the gas mixture can be of a type that is suitable for operating the pressurized cell 400 in the collision mode or KED mode.

In some embodiments, one or more of the gases in the gas mixture may be effective to react with certain ions in the cell 400 when the cell is operated in the reaction mode. The reactive gas of the gas mixture can be selected, for example, to be reactive with an interfering ion, while at the same time being inert toward one or more analyte ions. Alternatively, the selected reactive gas of the gas mixture can be inert toward the interfering ions and reactive with one or more of the analyte ions. For example, if the reactive gas of the gas mixture is selected to be reactive with the interfering ions, mass filtering may then be performed in the pressurized cell 400 to transmit or provide only the analyte ions from the cell. Notwithstanding that the same gas mixture can be used in both the collision mode and the reaction mode, the reactive gas can also be provided within the pressurized cell 400 up to a predetermined pressure, which can be the same predetermined pressure as the gas mixture, and can be the same or different depending on whether the cell is operated in the reaction mode or the collision mode. In some embodiments, the gas mixture can be provided within the pressurized cell 410 to a predetermined pressure within the range of about 0.02 milliTorr to about 0.04 milliTorr when the cell is operated in the KED mode and a range of about 0.04 milliTorr to about 0.065 milliTorr when the cell is operated in the DRC mode. The exact pressure used, however, can be varied depending in the instrument, cell dimensions and other factors. For example, to determine a suitable cell pressure, one or more standards can be used to calibrate the cell pressure and optimize the various gas flows and pressures in the system. In some instances, suitable cell pressures and flows are selected based on minimizing background equivalent concentrations. In certain examples, the pressure/flow calibration can be performed periodically to verify that the proper pressures and flows are being used for a particular analysis.

In some examples, one or more pumps, valves, outlets, etc. (not shown) can also be fluidly coupled to the pressurized cell 400 and can be operable to evacuate gas that is housed within the pressurized cell 400. Through synchronous operation of the pump and the gas source(s), the pressurized cell 400 may be repeatedly and selectively filled with, and then emptied of, a suitable gas mixture during operation of the mass spectrometer system. For example, the pressurized cell 400 may be filled with and then emptied of a quantity of a first gas mixture, alternately with filling and emptying of a quantity of a selected second gas mixture different from the first gas mixture. In this way, the pressurized cell 400 may be made suitable for alternate and selective operation in the collision and reaction modes using different gas mixtures. If desired, the pressurized cell 400 can be evacuated prior to switching from the collision mode to the reaction mode even though the same gas mixture can be used in the two modes.

In certain embodiments, the cell 400 may comprise a quadrupole rod set 410 (or other rod sets to provide a hexapole, octopole, etc.) in addition to the entry lens 420 and the exit lens 430. While not shown, the cell 400 may also comprise a fluid outlet or vent to evacuate the contents of the cell 400. The ion optical elements located upstream of the quadrupole rod set 410 can also be configured so as to control each respective energy distribution, for example in terms of the corresponding range, of the various ion populations in the ion stream and to minimize energy separation during transmission from an ionization source to the quadrupole rod set 410. One aspect of this control can involve maintaining the entry lens 420 at or slightly less than ground potential, thereby minimizing any ion field interactions at the entry lens 420 that could otherwise cause energy separation in the ion populations. For example, the entry lens 420 can be supplied by a power supply with an entrance potential falling in the range between −60 Volts and +20 Volts in the collision mode of the cell 400. Alternatively, the entry potential supplied to the entry lens 420 can be in the range between −3V and 0 (ground potential). While not required, maintaining the magnitude of the entry potential at a relatively low level can help to keep the corresponding energy distributions of different ion groups in the ion stream within a relatively small range.

In some embodiments, the range of the corresponding energy distribution for each respective ion population in the ion stream can be controlled and maintained, during transmission from the ionization source to the cell 400, to be within 5 percent of the corresponding initial range. Alternatively, each ion population's respective energy distribution can be controlled and maintained to within a maximum range selected to provide good kinetic energy discrimination in the pressurized cell 400 through collision with the gas mixture therein. This maximum range of the corresponding energy distributions can be equal, for example, to about 2 eV, measured at full-width, half-max.

In some embodiments, the exit lens 430 can also be supplied with a DC voltage by the voltage source so as to be maintained at a selected exit potential. In some embodiments, the exit lens 430 can receive a lower (i.e. more negative) exit potential than the entrance potential provided to the entry lens 420, to attract positively charged ions in the pressurized cell 400 toward to the exit end of the pressurized cell 400. Moreover, the absolute magnitude of the exit potential can be larger, perhaps even significantly larger, than the supplied entrance potential. The exit potential at which the exit lens 430 can be maintained may, in some embodiments, be within the range defined between −40V and −18V. In other configurations, the exit lens 430 can be maintained at a voltage between −26 Volts and +26 Volts in the collision mode of the pressurized cell 400. If desired, the exit lens 430 can be maintained at a voltage between −26 Volts and +26 Volts in the reaction mode of the pressurized cell 400. In some instances, it may be desirable to maintain the entrance member 420 at a voltage substantially similar to a voltage provided to the exit member 430 when the pressurized cell 400 is in the reaction mode. In some examples, a single voltage source may provide power to both the lenses 420, 430, whereas in other configurations, each of the lenses 420, 430 can be electrically coupled to their own respective voltage source (not shown). In one illustration, the entry lens 420 may comprise an entry lens orifice of about 4 mm to about 5 mm. The exit lens orifice can be smaller or larger than the entrance lens orifice, and in some instances comprises an orifice of about 2.5 mm to about 3.5 mm. Other size orifices may be viable as well to receive and eject the ion stream from the pressurized cell. Also, the pressurized cell 400 can be generally sealed off from the vacuum chamber to define an interior space suitable for housing quantities of a gas mixture.

In certain embodiments, the mass analyzer 250 present in the systems described herein may generally be any suitable type of mass analyzer including, but not limited to, a resolving quadrupole mass analyzer, a double quad mass analyzer, a triple quad mass analyzer, a segmented mass analyzer, a hexapole mass analyzer, a time-of-flight (TOF) mass analyzer, a linear ion trap analyzer, or some combination of these elements. While not shown, the mass analyzer 250 typically is electrically coupled to a suitable power supply and a processor to control the voltages provided to the components of the mass analyzer 250. The mass analyzer 250 can share a common power source with the lenses and/or multimode cell of the system or may comprise its own respective power supply. Ions provided to the mass analyzer 250 can be mass differentiated (in the case of Mass-Selective Axial Ejection, in space, not time) and transmitted to the detector 260 for detection, which can be any suitable detector as will be understood. Illustrative detectors include, but are not limited to, electron multipliers, multi-channel plates, chevrons and the like. For example, illustrative detectors are described in commonly assigned U.S. Patent Publication Nos. 20160379809 and 20160223494, the entire disclosure of each of which is hereby incorporated herein by reference. If desired, a voltage source can also provide a downstream offset (DC) bias voltage to the mass analyzer 250. The mass analyzer 250 can be housed in a vacuum chamber evacuated by the mechanical pump or other pumps.

In some embodiments, additional components may be present between any of the components or stages 210-260 shown in FIG. 2. For example, a pre-filter can be present between the cell 240 and the downstream mass analyzer 250 for use as a transfer element between these two components. The pre-filter can be operated in RF-only mode to provide radial confinement of the ion stream between the pressurized cell 240 and the downstream mass analyzer 250 and/or to reduce the effects of field-fringing that might otherwise occur. In other embodiments, the pre-filter may also receive a DC voltage to provide additional mass filtering of ions before transmission into the mass analyzer 250, for example to address space charge issues, or the like.

In certain embodiments, the pressurized cell 240 can be provided with a cell offset voltage and the mass analyzer 250 can be provided with a downstream offset voltage, which can be DC voltages supplied by a single or multiple different voltage sources electrically coupled to the corresponding component. The amplitude of each applied offset voltage can be fully controllable. In one case, the downstream offset voltage can be more positive than the cell offset voltage, thereby maintaining the mass analyzer 250 at an electrical potential above the pressurized cell 240. For positive ions transmitting from the pressurized cell 240 to the mass analyzer 250, this potential difference can present a positive potential barrier for ions to overcome. The relative positive difference can provide an exit barrier at the downstream end of the pressurized cell 240 for ions to penetrate. Ions with at least a certain minimum kinetic energy can penetrate the exit barrier, while slower ions not having sufficient kinetic energy can become trapped within the pressurized cell 240. If the strength of the exit barrier is selected appropriately, for example through control of the size of the potential difference between the mass analyzer 250 and the pressurized cell 240, then the exit barrier can discriminate selectively against one population or group of ions relative to another, such that a greater proportion of the one group of ions relative to the other may be trapped by the barrier and prevented from exiting the pressurized cell 240. Controlling the downstream offset voltage to be more positive than the cell offset voltage can make the mass spectrometer system 200 suitable for operation in the collision mode (KED mode). As noted herein, a gas mixture can be provided to the cell 240 (or other component upstream of the mass analyzer 250) to pressurize the cell 240 in the collision mode.

In another configuration, the downstream and cell offset voltages (and thus also the difference therebetween) can be controlled to make the cell offset voltage more positive than the downstream offset voltage. With the offset voltages controlled, the mass spectrometer 200 can be suitable for operation in a reaction mode. Rather than providing an exit barrier as described above, maintaining the mass analyzer 250 at a lower electrical potential than the pressurized cell 240 can accelerate ions into the mass analyzer 250 from the pressurized cell 240 and provide more efficient transmission of analyte ions between these two stages. As noted above, the interfering ions can react with the reactive gas of the gas mixture to form product ions, which can then be destabilized and ejected by tuning the pressurized cell 240 to apply a narrow bandpass filter around the m/z of the analyte ions. In this configuration, only the analyte ions should be accelerated into the mass analyzer 250. If a trapping element is provided downstream of the pressurized cell 240, the accelerating force provided by the potential drop can also sometimes be an effective way to induce in-trap ion fragmentation of the analyte ions, for example, if fragmentation is desired.

In some embodiments, a processor is present, e.g., in a controller or as a stand-alone processor, to control and coordinate operation of the mass spectrometer 200 for the various modes of operation using the gas mixture. For this purpose, the processor can be electrically coupled to each of the gas source, one or more pumps, one or more voltage sources for the pressurized cell 240 and/or the downstream mass analyzer 250, as well as any other voltage or gas sources included in the mass spectrometer 200 not shown in FIG. 2. For example, the processor can be operable to switch the mass spectrometer 200 from the collision mode to the reaction mode of operation, and further from the reaction mode back to the collision mode of operation. More generally, the processor can selectably switch between these two modes of operation or more than two modes of operation. As will be described in more detail, in order to make the switch from one mode of operation to the other, the processor can set, adjust, reset, or otherwise control, as needed, one or more settings or parameters of the mass spectrometer system 200 based one or more other setting or parameters.

In certain configurations, the processor may be present in one or more computer systems and/or common hardware circuity including, for example, a microprocessor and/or suitable software for operating the system, e.g., to control the voltages, pumps, mass analyzer, detector, etc. In some examples, the system itself may comprise its own respective processor, operating system and other features to permit operation of the system in a collision mode and a reaction mode using the gas mixture. The processor can be integral to the systems or may be present on one or more accessory boards, printed circuit boards or computers electrically coupled to the components of the system. The processor is typically electrically coupled to one or more memory units to receive data from the other components of the system and permit adjustment of the various system parameters as needed or desired. The processor may be part of a general-purpose computer such as those based on Unix, Intel PENTIUM-type processor, Motorola PowerPC, Sun UltraSPARC, Hewlett-Packard PA-RISC processors, or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects may be implemented as specialized software executing in a general-purpose computer system. The computer system may include a processor connected to one or more memory devices, such as a disk drive, memory, or other device for storing data. Memory is typically used for storing programs, calibrations and data during operation of the system in the various modes using the gas mixture. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the system to switch between the different modes and/or to switch between different gas mixtures. For example, computer control can be implemented to control the pressure within the cell, voltages provided to the cell and/or lens elements, etc. The processor typically is electrically coupled to a power source which can, for example, be a direct current source, an alternating current source, a battery, a fuel cell or other power sources or combinations of power sources. The power source can be shared by the other components of the system. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the various electrical devices present in the systems. Such circuitry can be present on a printed circuit board or may be present on a separate board or device that is electrically coupled to the printed circuit board through a suitable interface, e.g., a serial ATA interface, ISA interface, PCI interface or the like or through one or more wireless interfaces, e.g., Bluetooth, Wi-Fi, Near Field Communication or other wireless protocols and/or interfaces.

In certain embodiments, the storage system used in the systems described herein typically includes a computer readable and writeable nonvolatile recording medium in which codes can be stored that can be used by a program to be executed by the processor or information stored on or in the medium to be processed by the program. The medium may, for example, be a hard disk, solid state drive or flash memory. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC) or a field programmable gate array (FPGA). Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known Pentium class processors available from the Intel Corporation. Many other processors are also commercially available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS X, e.g., Snow Leopard, Lion, Mountain Lion or other versions available from Apple, the Solaris operating system available from Sun Microsystems, or UNIX or Linux operating systems available from various sources. Many other operating systems may be used, and in certain embodiments a simple set of commands or instructions may function as the operating system.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C# (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the systems may comprise a remote interface such as those present on a mobile device, tablet, laptop computer or other portable devices which can communicate through a wired or wireless interface and permit operation of the systems remotely as desired.

In certain examples, the processor may also comprise or have access to a database of information about atoms, molecules, ions, and the like, which can include the m/z ratios of these different compounds, ionization energies, and other common information. The database can include further data relating to the reactivity of the different compounds with other compounds, such as whether or not two compounds will form molecules or otherwise be inert toward each other. The instructions stored in the memory can execute a software module or control routine for the system, which in effect can provide a controllable model of the system. The processor can use information accessed from the database together with one or software modules executed in the processor to determine control parameters or values for different modes of operation for the mass spectrometer including the collision and reaction modes of operation. Using input interfaces to receive control instructions and output interfaces linked to different system components in the mass spectrometer system, the processor can perform active control over the system. For examples, in the KED or collision mode of operation, the processor can enable a source of the gas mixture, such as a helium gas and a hydrogen gas mixture, and then drive the gas source to fill the pressurized cell with a quantity of the gas mixture up to predetermined pressure. The processor can also set the downstream offset voltage to be more positive than the cell offset voltage, thereby forming the exit barrier at the exit end of the pressurized cell. Ions admitted into the pressurized cell can collide with one or more components of the gas mixture and undergo reductions in their respective kinetic energies. The average reduction in kinetic energy can depend on the average collisional cross-section of the ion kind, with ions of a larger collisional cross-section tending to undergo greater reductions in kinetic energy, relative to ions with a smaller cross-section, even where the two kinds of ions have substantially the same or similar m/z ratios. Thus, due to collisions with the inert gas, a group of polyatomic interfering ions can have its average kinetic energy reduced to a greater extent than a group of monatomic analyte ions. If the corresponding energy distributions of these two groups of ions are controlled during transmission from the ion source to the pressurized cell to be within the selected maximum range for the mass spectrometer system, then collision with the gas mixture can introduce an energy separation between the two groups. Thus, a larger proportion of the interfering ions can experience reduced energies relative to the analyte ion group with the effect that, through the processor controlling the size of the exit barrier, a greater proportion of the interfering ions will be unable to penetrate the exit barrier than the analyte ions. As noted herein, the exact amplitude of the exit barrier can generally depend on the interfering and analyte ions, and the processor may control the difference between the downstream and cell offset voltages based on one or both of the interfering and analyte ion kinds.

In certain configurations, the processor may control the difference between the downstream and cell offset voltages based upon other system parameters, such as the entry or exit potentials applied to the entry lens and the exit lens, respectively.

In other configurations, the processor can also be configured to adjust or tune the downstream and cell offset voltages forming the exit barrier to improve kinetic energy discrimination between the interferer and analyte ions.

In additional configurations, the processor can also be configured to adjust the entrance potential applied to the entry lens in order to control the range of energy distributions of the constituent ion populations entering into the pressurized cell.

In further configurations, the processor may also control the RF voltages provided to the rod set of the cell by a voltage source in order to set or adjust the strength of the confinement field. In this way, the processor can set the confinement field within the rod set to a strength sufficient to confine at least a substantial portion of analyte ions within the rod set of the cell.

In certain examples, to switch from the KED or collision mode to the DRC or reaction mode of operation, the processor can control the pump to permit evacuation of the gas mixture from the pressurized cell and can enable a gas source to provide additional gas mixture (which can be the same or a different gas mixture as used in the collision mode) to be pumped into the pressurized cell to a predetermined pressure, for example. Even though the gas mixture may be the same in the collision mode and the reaction mode, the relative percentages of each gas in the gas mixture can be different in the collision mode than in the reaction mode. For example, where the gas mixture comprises a hydrogen and helium gas mixture, the amount of hydrogen gas present in the gas mixture can be higher in the collision mode than the amount of hydrogen gas present in the gas mixture when the system is operated in the reaction mode. Alternatively, where the gas mixture comprises a hydrogen and helium gas mixture, the amount of hydrogen gas present in the gas mixture can be lower in the collision mode than the amount of hydrogen gas present in the gas mixture when the system is operated in the reaction mode. When operated in the reaction mode, one or more components of the gas mixture can be generally inert toward the analyte ions but reactive with the interfering ions (or vice versa). The processor can also, for example by accessing a linked database, determine one or more types of potential interfering ions based upon one or more identified analyte ions of interest. The interfering ions determined by the processor may have substantially the same or similar m/z ratios as the analyte ions. The processor can also select a suitable gas mixture in a similar way. Once a gas mixture has been selected, the processor can control the gas source to provide a quantity of the gas mixture into the pressurized cell for operation in the reaction mode.

In certain examples, when the system is operated in the reaction mode, the processor may control operation of the mass spectrometer substantially as described in U.S. Pat. Nos. 6,140,638 and 6,627,912. Additionally, the processor can be configured to instruct the voltage source to provide a downstream offset voltage that is more negative than the cell offset voltage. The determination of the difference may again be made based upon the interfering and/or analyte ions. The processor may also be configured to adjust or tune the offset voltage difference.

In certain embodiments, to switch from the reaction mode of operation back to the collision mode of operation, the processor can instruct the pump to evacuate the selected gas mixture from the pressurized cell, and subsequently control the gas source to provide a quantity of the gas mixture to the pressurized cell. The downstream and cell offset voltages, as well as other system parameters, may also be adjusted by the processor as described above to be suitable for operation in the collision mode. This switching between modes using the gas mixture can take place as often as desired. In addition, the cell can be held in a standard or vented mode between runs in the collision mode and the reaction mode. If desired, analysis can occur while the cell is held in the vented or standard mode, e.g., where no gas mixture is present in the cell.

Figure 3A:
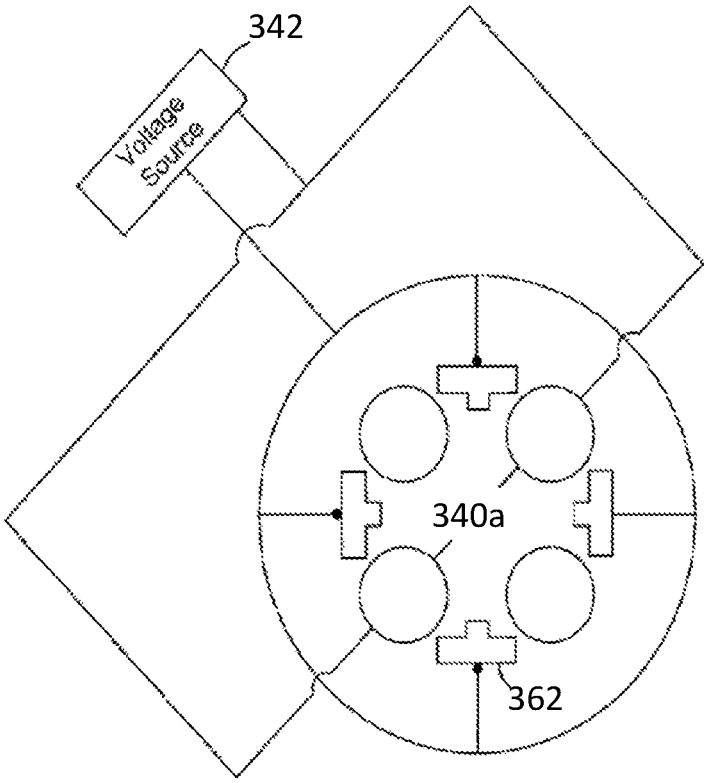
FIGS. 3A and 3B are illustrations of a multimode cell showing axial electrodes, in accordance with certain embodiments.
Figure 3B:
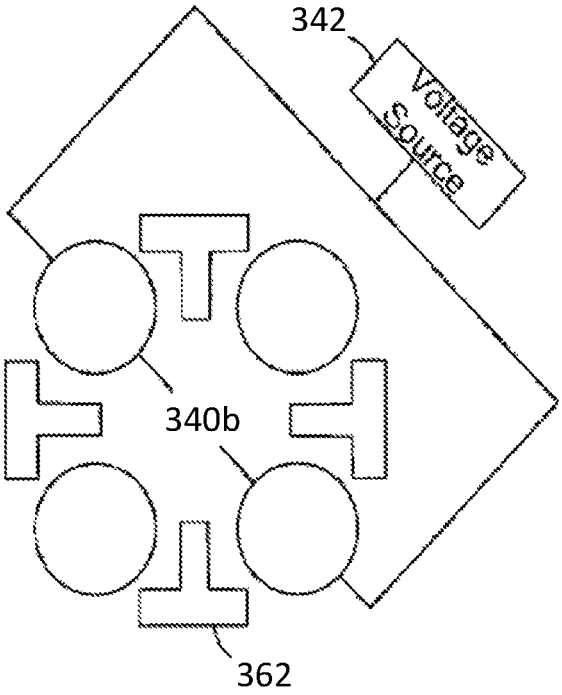

In certain embodiments and with reference again to FIGS. 3A and 3B, in front and rear cross-sectionals views, respectively, are auxiliary electrodes 362 that can be included in alternative embodiments. FIGS. 3A and 3B illustrate quadrupole rod sets 340*a*, 340*b* and voltage source 342, as well as the connections therebetween, though hexapole or octopole rod sets (or other rod sets) could instead be used. The pair of rods 340*a* can be coupled together (FIG. 3A) as can the pair of rods 340*b* (FIG. 3B) to provide the quadrupolar confinement field. For example, the pair of rods 340*a* can be provided with a voltage as described in U.S. Pat. No. 8,426,804. The auxiliary electrodes 362 can be included in the pressurized cell to supplement the quadrupolar confinement field with an axial field, i.e. a field that has a dependence on axial position within the quadrupole rod set. As illustrated in FIGS. 3A and 3B, the auxiliary electrodes can have a generally T-shaped cross-section, comprising a top portion and a stern portion that extends radially inwardly toward the longitudinal axis of quadruple rod set. The radial depth of the stem blade section can vary along the longitudinal axis to provide a tapered profile along the length of the auxiliary electrodes 362. FIG. 3A shows the auxiliary electrodes from the downstream end of the pressurized cell looking upstream toward the entrance end, and FIG. 3B shows the reverse perspective looking from the entrance end downstream to the exit end. The inward radial extension of the stem portions lessens moving downstream along the auxiliary electrodes 362. Each individual electrode can be coupled together to the voltage source 342 to receive a DC voltage. As will be appreciated, this geometry of the auxiliary electrodes 362 and the application of a positive DC voltage can provide an axial field of a polarity that will push positively charged ions toward the exit end of the pressurized cell. It should also be appreciated that other geometries for the auxiliary electrodes could be used to equal effect, including, but not limited to, segmented auxiliary electrodes, divergent rods, inclined rods, as well as other geometries of tapered rods and reduced length rods. Neglecting fringe effects at the ends of the rods and other practical limitations, the axial field created by the auxiliary electrodes can have a substantially linear profile. The gradient of the linear field can also be controllable based upon the applied DC voltage and the electrode configuration. For example, the applied DC voltage can be selected to provide an axial field gradient in the range between −500 V/cm and +500 V/cm. The processor can also control the voltage source 342 so that the supplied DC voltage to the auxiliary electrodes 362 forms an axial field of a selected field strength, defined for example in terms of its axial gradient. The auxiliary electrodes 362 may be energized for each of the KED and DRC modes of operation, though at different field strengths. The processor may also control the relative field strengths for each mode of operation. In either mode of operation, the auxiliary electrodes 362 can be effective in sweeping reduced energy ions out of quadrupole by pushing the ions toward the exit end of the pressurized cell. The magnitude of the applied axial field strength can be determined by the processor based upon the interfering and analyte ions in the ion stream, as well as other system parameters as described herein.

In certain embodiments, the exact ionization source used with the cells and systems described herein can vary. In a typical configuration, the ionization source is operative to generate ions from an aerosolized sample introduced into the ionization source. For certain mass spectrometry applications, for example those involving analysis of metals and other inorganic analytes, analysis can be desirably performed using an inductively coupled plasma (ICP) ion source in the mass spectrometer, due to the relatively high ion sensitivities that can be achieved in ICP-MS. To illustrate, ion concentrations below one part per billion are achievable with ICP ion sources. In a conventional inductively coupled plasma ion source, the end of a torch consisting of three concentric tubes, typically quartz tubes, can be placed into an induction coil supplied with a radio-frequency electric current. A flow of argon gas can then be introduced between the two outermost tubes of the torch, where the argon atoms can interact with the radio-frequency magnetic field of the induction coil to free electrons from the argon atoms. This action can produce a very high temperature plasma, e.g., 10,000 Kelvin, comprising mostly of argon atoms with a small fraction of argon ions and free electrons. The analyte sample can then be passed through the argon plasma, for example as a nebulized mist of liquid. Droplets of the nebulized sample can evaporate, with any solids dissolved in the liquid being broken down into atoms and, due to the extremely high temperatures in the plasma, stripped of their most loosely-bound electron to form a singly charged ion. While conventional ICP sources can be used with the cells and systems described herein, low flow plasmas, capacitively coupled plasmas and the like may also be used with the cells and systems described herein. Various plasmas and devices used to produce them are described, for example, in U.S. Pat. Nos. 7,106,438, 7,511,246, 7,737,397, 8,633,416, 8,786,394, 8,829,386, 9,259,798, 9,504,137 and 9,433,073.

In certain examples and as noted herein, use of an ICP can generate interfering ions in the process of ionizing analyte ions of interest. For example, the above-listed inorganic spectral interferences, e.g., $Ar^+$, $ArO^+$, $Ar_2^+$, $ArCl^+$, $ArH^+$, and $MAr^+$, may be especially present in the ion stream. The various different populations of ions of different kinds can, together with other potential interferences, make up the ion stream provided from the ionization source. Each particular ion present in the ion stream will have a corresponding m/z ratio, though it will not necessarily be unique within the ion stream as the interfering ions may have the same or similar m/z ratio as the analyte ions. For example, the ion stream could comprise a population of $^{56}Fe^+$ analyte ions, together with a population of $^{40}Ar^{16}O^+$ interfering ions generated by the ICP. Each of these two ions have a m/z ratio of 56. As another non-limiting example, the analyte ion kind could be $^{80}Se^+$, in which case $^{40}Ar_2^+$ would constitute an interfering ion, since the analyte of interest and the interfering ions each have a of m/z of 80. As noted herein, the respective ion populations in the ion stream emitted from the ionization source can also define corresponding energy distributions with respect to the energies of the individual ions making up the populations. Each individual ion in a respective population can be emitted from the ionization source having a certain kinetic energy. The individual ion energies taken over the ion population can provide an energy distribution for that population. These energy distributions can be defined in any number of ways, for example, in terms of a mean ion energy and a suitable metric providing a measure of the energy deviation from the mean ion energy.

In certain instances, one suitable metric can be the range of the energy distribution measured at full-width at half-max (FWHM). When the ion stream is emitted from the ionization source, each population of ions in the stream can have respective initial energy distributions defined, in part, by corresponding initial ranges. These initial energy distributions need not be preserved as the ion stream is transmitted from the ionization source to downstream components included in the mass spectrometer. Some energy separation in the ion populations can be expected, for example due to collisions with other particles, field interactions, and the like. It may be convenient to describe the ion stream in terms of the respective energy distributions of its constituent ion populations at different locations throughout the mass spectrometer. In some embodiments, each ion population has substantially the same initial range of energy distributions when emitted from the ionization source. As noted herein, a gas mixture can be used to remove the interfering ions from the analyte ions in the ion beam to permit detection of the analyte ions in both a collision mode and a reaction mode.

Figure 5:
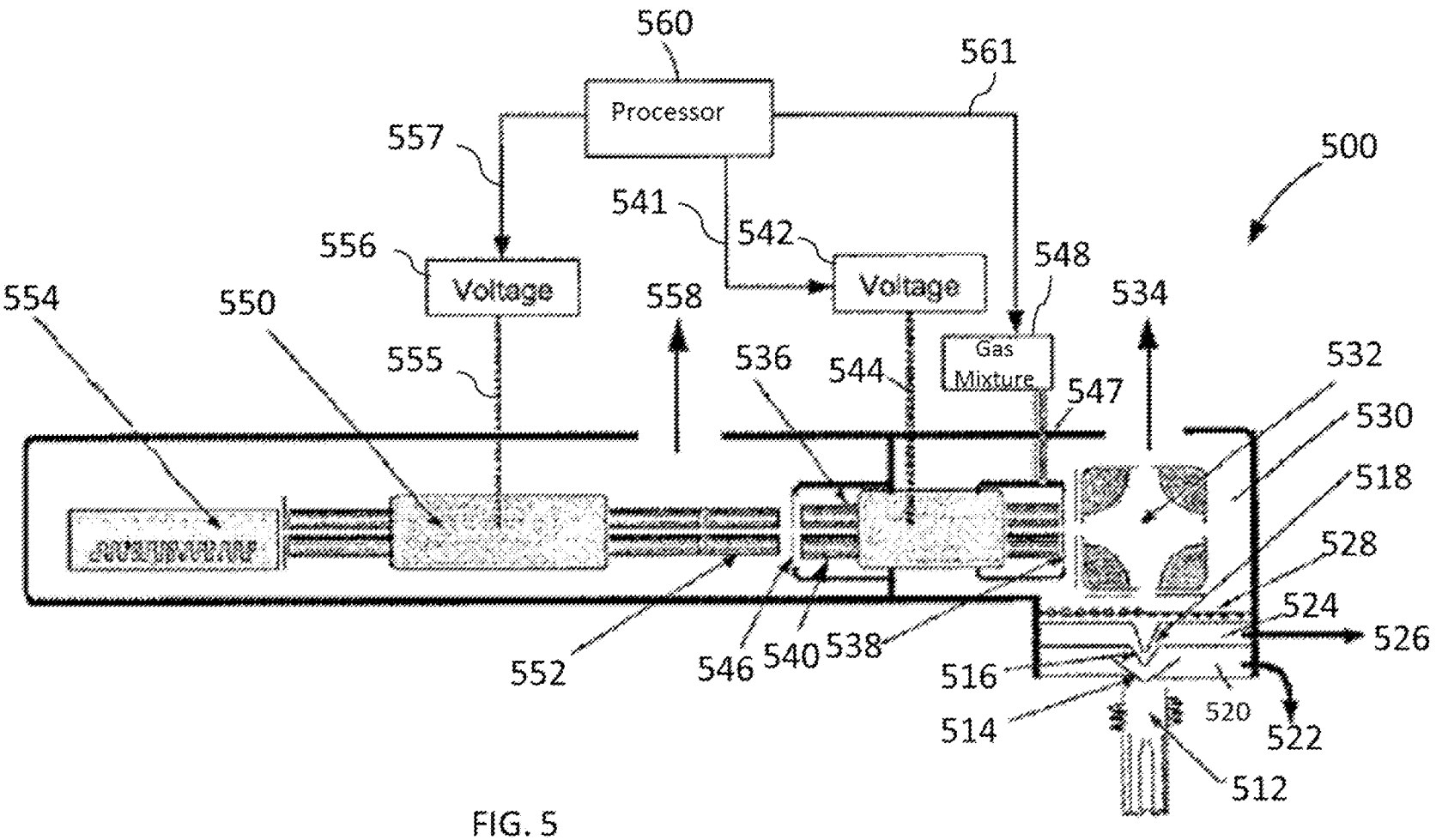
FIG. 5 is an illustration of a system configured to introduce a gas mixture into a multimode cell, in accordance with certain embodiments.

In certain examples and referring to FIG. 5, a mass spectrometer system comprising an ICP and a multimode cell suitable for use with a gas mixture is shown. The system 500 comprises an ICP ionization source or ICP ion source 512, a sampler plate 514, a skimmer 516, a first vacuum chamber 520, a second vacuum chamber 524 comprising a secondary skimmer 518, an interface gate 528, a third vacuum chamber 530 which comprises an ion deflector 532, a multimode cell 536 comprising an entry member 538, an exit member 546 and a rod set 540, e.g., 2, 4, 6, 8 or 10 rods, a pre-filter 552, a mass analyzer 550 and a detector 554. The mass analyzer 550 is electrically coupled to a voltage source 556 through an interconnect 555. The voltage source 556 is electrically coupled to a processor 560 through an interconnect 557. The processor 560 is also electrically coupled to another voltage source 542 through an interconnect 541. The voltage source 542 is electrically coupled to the rod set 540 of the pressurized cell 536 through an interconnect 544. The processor 560 is also electrically coupled to a gas source 548 comprising a gas mixture (though as noted herein two or more separate gas sources could instead be used to introduce a gas mixture into the cell 536) through an interconnect 561. A single gas inlet 547 provides fluidic coupling between the gas source 548 and the cell 536. A mechanical pump (not shown) can evacuate the vacuum chamber 520 in the general direction of arrow 522. For example, the chamber 520 may be at a pressure of about 3 Torr during operation of the system 500. Another mechanical pump (not shown) can evacuate the second vacuum chamber 524 in the general direction of arrow 526. For example, the chamber 524 may be at a pressure of about 1 to 110 milliTorr during operation of the system 500. An additional mechanical pump (not shown) can be fluidically coupled to the third vacuum chamber 530 to remove gas in the general direction of arrow 534. The third vacuum chamber 530 is typically at a lower pressure than the second vacuum chamber 524. Another pump can be fluidically coupled to a vacuum chamber of the mass analyzer 550 to remove gas in the general direction of arrow 558. As noted herein, the processor 560 can control the system 500 to permit introduction of the gas mixture into the cell 536 during operation in both a collision mode and in a reaction mode. For example, the processor 560 can be configured to permit switching of the cell 536 to a vented mode, a KED mode and/or a collision mode. As noted herein, only a single gas inlet 547 may be present between the cell 536 and the gas source 548 to introduce the gas mixture, e.g., a binary gas mixture. The exact number of rods of the rod set 540 may vary from 2, 4, 6, 8, or 10 rods, with a quadrupolar rod set being used in many instances. In some embodiments, the exit member 546 may comprise a voltage between −60 Volts and +20 Volts in the collision mode of the pressurized cell 536. In other instances, the exit member 546 may comprise a voltage between −60 Volts and +20 Volts in the reaction mode of the pressurized cell 536. In further configurations, the entrance member 538 can be set at a voltage between −60 Volts and +20 Volts in the collision mode of the pressurized cell 536. In some examples, the entrance member 538 can be set at a voltage substantially similar to a voltage provided to the exit member 546 when the pressurized cell 536 is in the reaction mode.

In some instances, the cell 536 is configured to switch from the collision mode to the reaction mode while maintaining the same gas flow or changing to a different flow level by switching the voltages on the entrance member 538 and/or the exit member 546 as well as changing the energy potential between the cell 536 and the downstream mass analyzer 550.

In other instances, the cell 536 is configured to switch from the reaction mode to the collision mode while maintaining the same gas flow or changing to a different flow level by switching the voltages on the entrance member 538 and/or the exit member 546 as well as changing the energy potential between the cell 536 and the downstream mass analyzer 550.

In certain configurations, the system 500 may also comprise axial electrodes (not shown), e.g., within the cell 536, electrically coupled to a voltage source and configured to provide an axial field to direct ions toward an exit aperture of the pressurized cell 536. For example, the axial field may comprise a field gradient between −500V/cm and 500 V/cm.

In some configurations, the processor 560 can be configured to provide an offset voltage to the pressurized cell 536. As noted herein, the exact offset voltage provided can depend on the mode of the cell and the analyte ions and any interfering ions. In certain instances, the mass analyzer 550 fluidically coupled to the cell 536 may comprise an offset voltage. For example, in some configurations, an offset voltage of the fluidically coupled mass analyzer 550 is more positive than the offset voltage of the cell 536 when the cell 536 is in the collision mode. In other configurations, an offset voltage of the fluidically coupled mass analyzer 550 is more negative than the offset voltage of the cell 536 when the cell 536 is in the reaction mode. In some examples, the gas mixture introduced into the cell 536 from the gas source 548 may comprise two, three, four or more different gases. For example, the gas mixture may comprise a binary gas mixture comprising helium gas and hydrogen gas. The exact level of each gas present in the mixture can vary and may be varied depending on the mode of the system 500. For example, one of the gases present in the mixture may be present up to about 15% by volume with the remainder of the gas mixture consisting essentially of the other gas (or gases). In examples where a binary gas mixture comprises hydrogen and helium, the hydrogen can be present, for example, up to about 15% by volume or up to about 11% by volume or up to about 8% or 6% by volume with the remainder (by volume) being substantially the helium gas.

Figure 6:
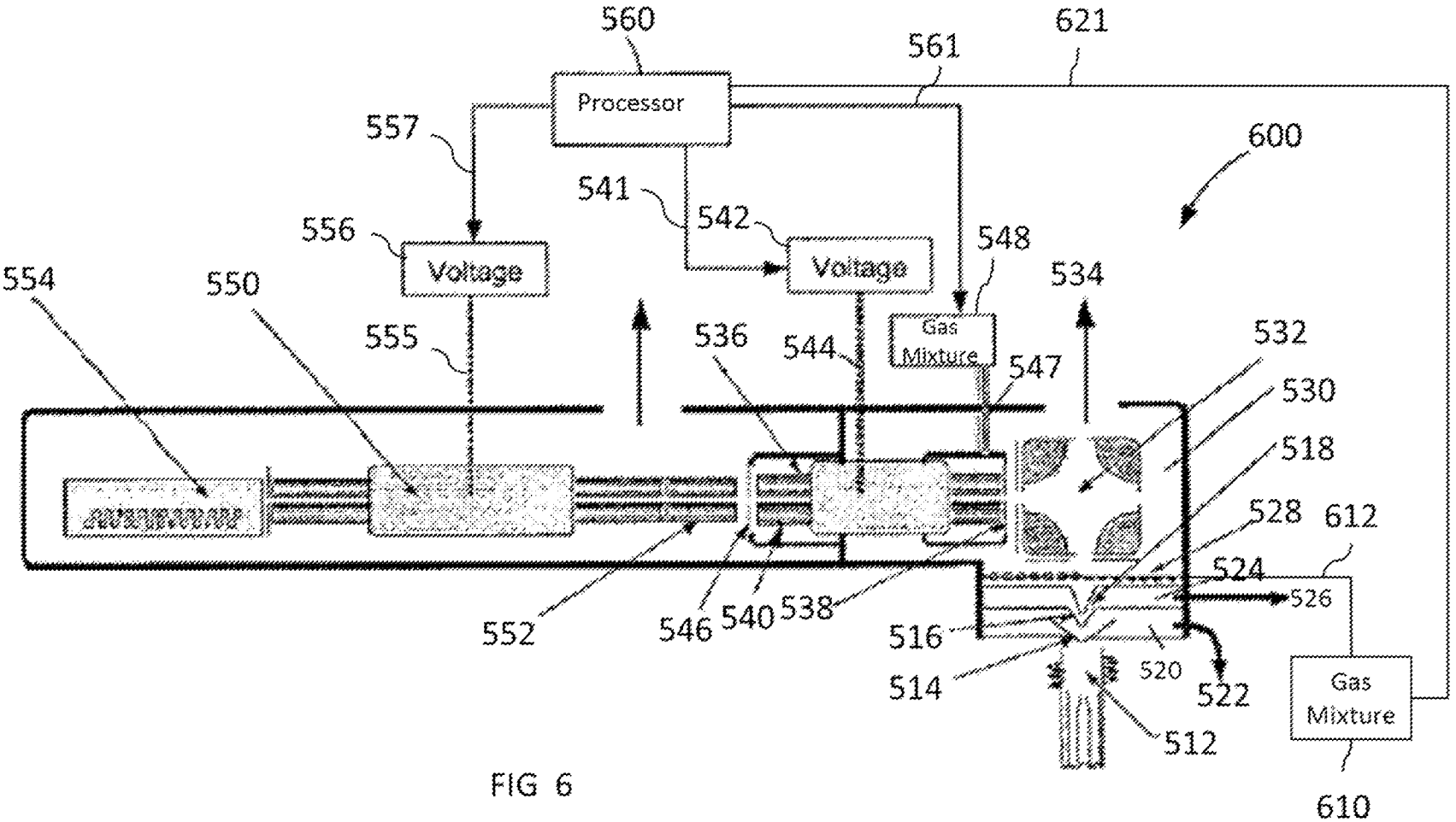
FIG. 6 is an illustration of a system configured to introduce a gas mixture into a multimode cell and to introduce a gas mixture upstream of the multimode cell, in accordance with certain examples.
Figure 7:
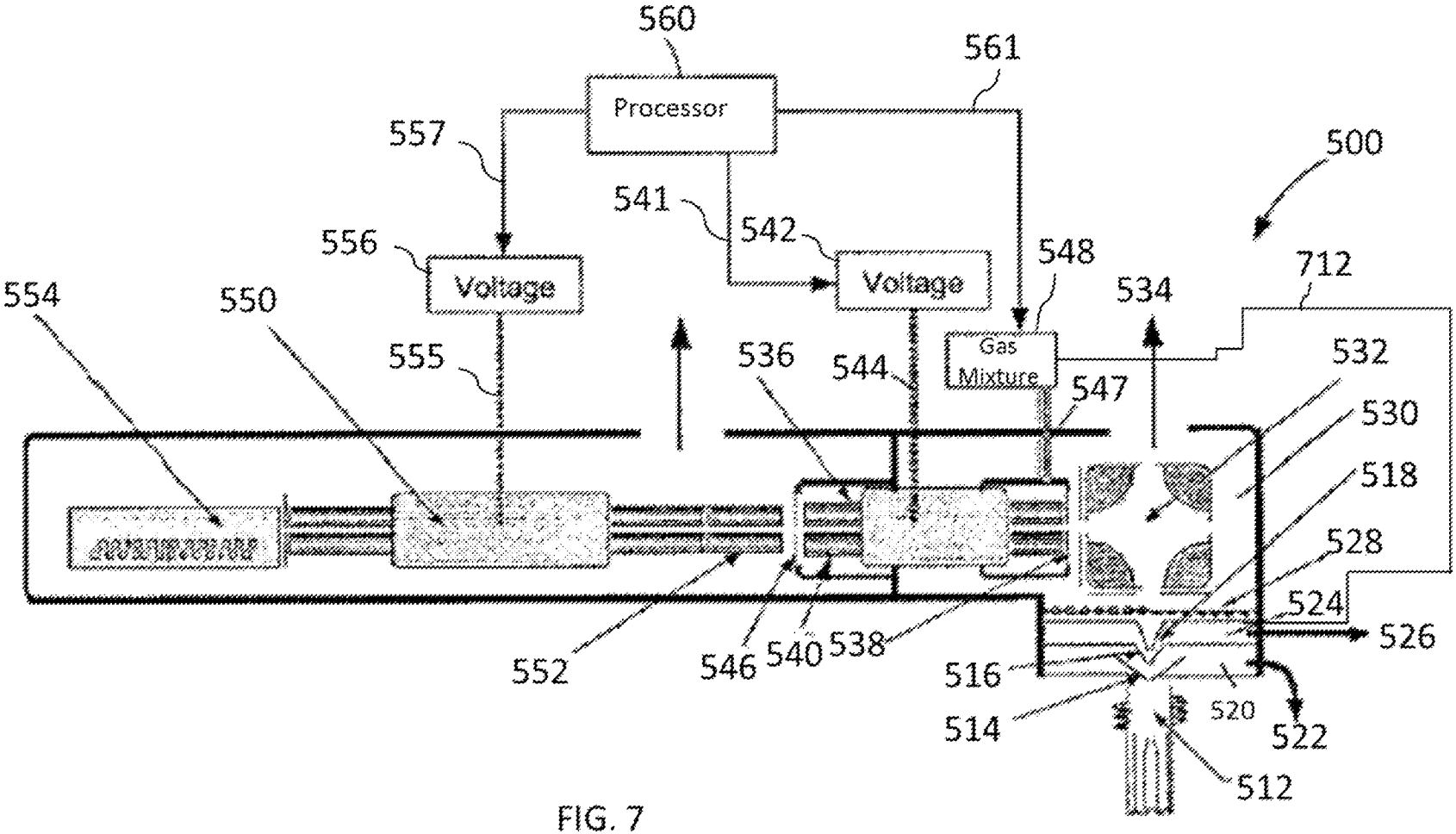
FIG. 7 is an illustration of a system configured to introduce a gas mixture from a common gas source into a multimode cell and to introduce the gas mixture upstream of the multimode cell, in accordance with certain examples.
Figure 8:
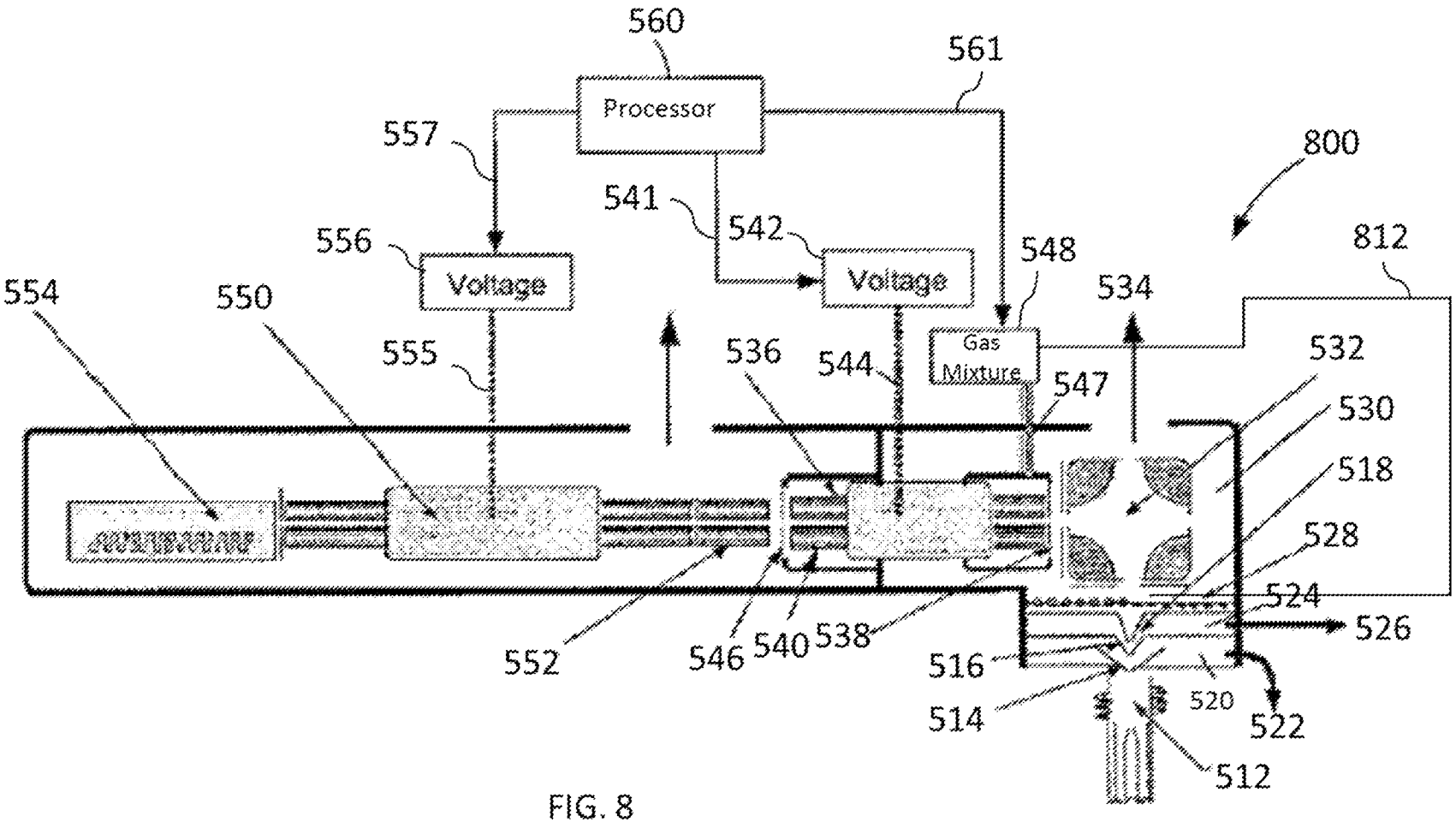
FIG. 8 is another illustration of a system configured to introduce a gas mixture from a common gas source into a multimode cell and to introduce the gas mixture upstream of the multimode cell, in accordance with certain examples.

In certain examples, the system 500 may be modified to introduce the gas mixture upstream of the cell 536 in addition to or in place of the gas mixture introduced into the cell 536. Various configurations of systems which introduce a gas mixture upstream of the cell 536 are shown in FIGS. 6-8. Components with the same number represent the same component in the different figures. Referring to FIG. 6, a system 600 comprises a gas source 610 configured to introduce a gas mixture into the space adjacent to the secondary skimmer 518. A fluid line 612 is present to provide the gas mixture into the secondary skimmer 518. An interconnect 621 electrically couples the gas source 610 to the processor 560. The processor 560 can control the gas source 610 to permit introduction of a desired amount of the gas mixture into the secondary skimmer 518. If desired, gas sources 548 and 610 can be independently controlled and may provide different gas flow rates, pressures and/or different gas mixtures to the respective portions of the system 600.

In accordance with certain examples, FIG. 7 shows a similar configuration to FIG. 6 except a common gas source is present and used to introduce the gas mixture into each of the cell 536 and the secondary skimmer 518. A fluid line 712 is present in the system 700 to provide fluidic coupling between the gas source 548 and the secondary skimmer 518. The processor 560 can be electrically coupled to valves in the gas source 548 to independently actuate the valves and permit or stop flow of the gas mixture independently in the fluid inlet 547 and the fluid line 712. If desired, different gas flow rates, pressures, etc. can be provided through the different fluid lines 547, 712.

In accordance with some configurations, the gas mixture can be introduced upstream of the cell 536 at locations other than the secondary skimmer 518. For example, the gas mixture can be introduced at the skimmer 516, at the end of the torch of the ICP source 512 or at other areas. One configuration is shown in FIG. 8 where the gas mixture is introduced upstream of the deflector 532 through a fluid line 812 in the system 800. The fluid line 812 introduces the gas mixture from the gas source 548 in the space between the secondary skimmer 518 and the deflector 532. While a common gas source 548 is shown in FIG. 8, there may be two separate gas sources similar to that shown in FIG. 6. It will be recognized by the person of ordinary skill in the art, given the benefit of this disclosure, that the gas mixture could also be introduced downstream of the deflector 532 in the space between the deflector 532 and the cell 536. If desired, different gas flow rates, pressures, etc. can be provided through the different fluid lines 547, 812.

In certain examples, the systems described herein may be particularly desirable for use in inorganic analyses where certain metal species cannot be adequately detected in a rapid manner. For example, it can be difficult to detect selenium at low levels using current ICP-MS methods and system. By using a gas mixture comprising two or more gases, e.g., a hydrogen and helium gas mixture, universal interferences can be removed and low levels of selenium can be detected. In some examples, interferences can be removed in the collision mode using the gas mixture and reaction capability also exists in the reaction mode using the gas mixture. Use of the same gas mixture is a substantial attribute as many MS systems include a single gas inlet and require switching of the gas from a first collision gas to a second, different reaction gas. This switching tends to slow analysis time.

Certain specific examples are described below to illustrate further some of the novel aspects and features of the technology described herein.

Example 1

Selenium levels were detected in various modes using a single collision gas (helium) and a mixture of gases (helium and hydrogen with hydrogen present at about seven (7)% by volume with the balance being helium gas and any minor impurities that could be present in the helium gas/hydrogen mixture). Detection limits (DL) of the selenium analyte were also measured in the reaction mode using the same mixture of gases (helium and hydrogen). The results are shown in Table I

TABLE 1

| Analyte | Mass | Blank 1 | RSD | SD | Blank 1 | RSD | SD | Blank 1 | RSD | SD | 10 ppb Se | DL (ppt) |
|---|---|---|---|---|---|---|---|---|---|---|---|---|
| Se KED (He only) | 78 | 65 | 13 | 9 | 71 | 7 | 5 | 71 | 18 | 13 | 2665 | 98 |
| Se KED (He/H Mixture) | 78 | 32 | 11 | 4 | 35 | 19 | 6 | 35 | 12 | 4 | 2414 | 59 |
| Se DRC (He/H Mixture) | 78 | 1801 | 3 | 46 | 1754 | 2 | 31 | 1731 | 2 | 40 | 124604 | 9 |

In comparing the detection limits in the collision mode (KED) using helium versus using the helium/hydrogen gas mixture, the selenium detection limits are lower when the gas mixture is used. Table 2 below lists the minimum detection limits (MDL) of selenium using the two modes and the helium/hydrogen gas mixture.

TABLE 2

| | | Using He/H Mixture | | | |
|---|---|---|---|---|---|
| | m/z | MDL-KED | MDL-KED | MDL-DRC | MDL-DRC |
| Se | 78 | 0.137 | 0.153 | 0.027 | 0.017 |

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples. Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A system configured to permit switching of a cell between at least two modes comprising a collision mode and a reaction mode to select ions received by the cell, the system comprising:

a cell configured to receive a gas mixture comprising a binary gas mixture in the collision mode to pressurize the cell and configured to receive the same gas mixture comprising the binary gas mixture in the reaction mode to pressurize the cell; and a processor electrically coupled to the cell, the processor configured to provide a voltage to the pressurized cell comprising the gas mixture in the collision mode to facilitate the transmission of select ions with an energy greater than an energy barrier induced by the provided first voltage, wherein the processor is further configured to provide a second voltage to the pressurized cell comprising the gas mixture in the reaction mode to guide select ions into a mass filter fluidically coupled to the cell.

2. The system of claim 1, in which the processor is further configured to permit switching of the cell to a vented mode.

3. The system of claim 1, in which the system further comprises a single gas inlet fluidically coupled to the cell to provide the gas mixture comprising the binary gas mixture.

4. The system of claim 3, in which the cell comprises a multipole rod set comprising of 2, 4, 6, 8, or 10 rods.

5. The system of claim 4, in which the cell further comprises an exit member positioned proximate to an exit aperture of the cell and electrically coupled to a voltage source, the exit member configured to direct analyte ions in the pressurized cell toward the exit aperture of the cell.

6. The system of claim 5, in which the exit member can be set at a voltage between −60 Volts and +20 Volts in the collision mode of the pressurized cell.

7. The system of claim 5, in which the exit member can be set at a voltage between −60 Volts and +20 Volts in the reaction mode of the pressurized cell.

8. The system of claim 5, in which the cell further comprises an entrance member positioned proximate to an entrance aperture of the cell and electrically coupled to a voltage source, the entrance member configured to direct analyte ions into the pressurized cell toward the entrance aperture of the cell.

9. The system of claim 8, in which the entrance member can be set at a voltage between −60 Volts and +20 Volts in the collision mode of the pressurized cell.

10. The system of claim 8, in which the entrance member can be set at a voltage substantially similar to a voltage provided to the exit member when the pressurized cell is in the reaction mode.

11. The system of claim 1, in which the cell is configured to switch from the collision mode to the reaction mode while maintaining the same gas flow or changing to a different flow level by switching the voltages on the entrance member and exit member and optionally changing the energy barrier between the cell and the mass analyzer.

12. The system of claim 1, in which the cell is configured to switch from the reaction mode to the collision mode while maintaining the same gas flow or changing to a different flow level by switching the voltages on the entrance member and the exit member and optionally changing the energy barrier between the cell and the mass analyzer.

13. The system of claim 1, further comprising axial electrodes electrically coupled to a voltage source and configured to provide an axial field to direct ions toward an exit aperture of the pressurized cell.

14. The system of claim 13, in which the axial field comprises a field gradient between −500 V/cm and 500 V/cm.

15. The system of claim 1, in which the processor is further configured to provide an offset voltage to the pressurized cell.

16. The system of claim 15, further comprising a mass analyzer fluidically coupled to the cell comprising the offset voltage.

17. The system of claim 16, in which an offset voltage of the fluidically coupled mass analyzer is more positive than the offset voltage of the cell when the cell is in the collision mode.

18. The system of claim 16, in which an offset voltage of the fluidically coupled mass analyzer is more negative than the offset voltage of the cell when the cell is in the reaction mode.

19. The system of claim 16, further comprising an ionization source fluidically coupled to the cell.

20. The system of claim 1, in which the cell is configured to use a binary mixture of helium gas and hydrogen gas in the collision mode and in the reaction mode.

* * * * *